United States Patent [19]

Melby

[11] Patent Number: 4,566,695

[45] Date of Patent: Jan. 28, 1986

[54] GAME RACKET HAVING ADJUSTABLE STRING MOUNTS

[76] Inventor: Phillip J. Melby, Box 656, Mason City, Iowa 50401

[21] Appl. No.: 476,034

[22] Filed: Mar. 17, 1983

[51] Int. Cl.[4] ..... A63B 51/12

[52] U.S. Cl. ..... 273/73 D; 273/73 E

[58] Field of Search ..... 273/73 R, 73 D, 73 C, 273/73 E

[56] References Cited

U.S. PATENT DOCUMENTS

| | | | |
|---|---|---|---|
| 1,292,317 | 1/1919 | Holding | 273/73 D |
| 1,526,734 | 2/1925 | Andrews . | |
| 1,559,986 | 11/1925 | Quick | 273/73 E |
| 1,572,542 | 2/1926 | Lawrence | 273/73 E |
| 1,621,746 | 3/1927 | Morten | 273/73 E X |
| 1,687,848 | 10/1928 | Robinson et al. | 273/73 D |
| 3,834,699 | 9/1974 | Pass | 273/73 C |
| 4,213,608 | 7/1980 | Krishnan | 273/73 D X |
| 4,241,916 | 12/1980 | Palm | 273/73 D |
| 4,441,712 | 4/1984 | Guthke | 273/73 D |

FOREIGN PATENT DOCUMENTS

| | | | |
|---|---|---|---|
| 25758 | 12/1935 | Australia | 273/73 C |
| 496124 | 7/1919 | France | 273/73 E |

*Primary Examiner*—Richard C. Pinkham
*Assistant Examiner*—Matthew L. Schneider
*Attorney, Agent, or Firm*—Robert T. Johnson

[57] ABSTRACT

A racket having a rectangularly shaped head portion with holes located therein for the reception of adjustable string mounts. The adjustable mounts consist of a threaded end for engagement with a nut and two looped portions at the opposite end for engagement with the strings. Additionally, blind holes are located in the frame for seating the looped portions after the mounts have been sufficiently tightened.

1 Claim, 6 Drawing Figures

GAME RACKET HAVING ADJUSTABLE STRING MOUNTS

BACKGROUND OF THE INVENTION

This invention pertains to a game racket for use in tennis, badminton, squash and similar games.

At the present time, game rackets, as mentioned above, are strung with strings comprised of lengths such that if a string breaks on using the racket, it then requires complete restringing of the racket. If the strings become loose, then it is necessary to completely restring the racket.

This present invention obviates the above complication of completely restringing rackets when a string breaks, or if a string becomes loose.

An object of this invention is to disclose a means of stringing a racket, wherein the strings are installed as "pairs". The string "pair" is comprised of a string loop and is fastened from one side to the other and other string pair fastened from top to bottom. The string pair is fastened on stud legs of mounting stud. The word string is here used to identify that which is used in stringing a racket.

Another object of this invention is to disclose a game racket comprising a frame and string mounted therein wherein said string is held taut on stud legs of mounting stud.

Another object is to disclose a game racket such as a tennis racket wherein a string loop is mounted on stud legs of mounting stud comprised of said stud legs and a male threaded mounting stud, with said threaded mounting stud section extending through the racket frame in hole provided and held rigidly in place by means of a nut screwed onto said male threaded mounting stud.

Another object is to disclose a game racket comprising a frame, a male threaded mounting stud comprising stud legs attached thereto, and string loops mounted on said stud legs, said string loops extending across said frame and mounted on stud legs on the opposite side of said frame.

Another object of this invention is to disclose means for tightening string loops mounted in a game racket such as a tennis racket, said means comprising a threaded nut screwed on adjustable mounting stud threaded section extending through the racket frame.

Another object of this invention is to disclose a game racket wherein a string loop is held taut by adjustment of threaded nut mounted on a male threaded mounting stud comprising said mounting stud and stud legs of mounting stud.

Another object of this invention is to disclose means to hold a string loop taut, by mounting said string loop in stud legs of mounting stud comprising said stud legs and adjustable mounting stud threaded section said string loop mounted on said stud legs on each end of said string loop, thus adjustment of tautness of the string loop is adjustable at either or both string loop ends.

Another object of this invention is to disclose a frame head of a tennis racket having a rectangular shaped head which is to include a square shaped frame head.

The rectangular shaped head of the racket, if not square, will have the long axis extend in the direction of length of the racket.

Another object of this invention is to disclose a game racket comprising a frame and handle, vertical and horizontal string loops, said string loops mounted on stud legs of mounting stud of adjustable mounting stud threaded section at each string loop end.

Previous patents considered in evaluating this present invention are as follows.

In U.S. Pat. No. 1,526,734, there is disclosed a method for keeping the strings tight by means of a wedging action on the strings. This does not in any way touch on this Melby invention.

In U.S. Pat. No. 1,621,746, there is disclosed a method of tightening individual strings by means of passing said string end through a threaded plug and a washer upon the outside of the plug adapted to receive the knotted end of the string.

In U.S. Pat. No. 1,687,848, there is disclosed a method of stringing a racket to hold the strings taut, by specific knots tied in the string end.

None of the above patents cover this present invention.

SUMMARY OF THE INVENTION

The game racket of this invention comprises a square or rectangular shape and individual string loops which are stretched from side to side and other string loops from top to bottom. Each loop when mounted in the racket is attached to opposing studs, such that the string loop comprises two strings of the racket, with the two string pair extending in the same direction.

The adjustable studs on the racket can be on each end of the string loop or on one end only of the loop, with the other end of the string loop attached to stationary or non-adjustable stud.

If only one end of string loop is attached to an adjustable stud, and the other end of the string loop attached to non-adjustable stud legs, then the adjustable studs are alternated from side to side or top to bottom to balance the racket.

The string loop is to identify the string for the racket prior to mounting in the racket.

DESCRIPTION OF THE DRAWINGS

FIG. 1—A tennis racket of this invention wherein:

Figure 2:
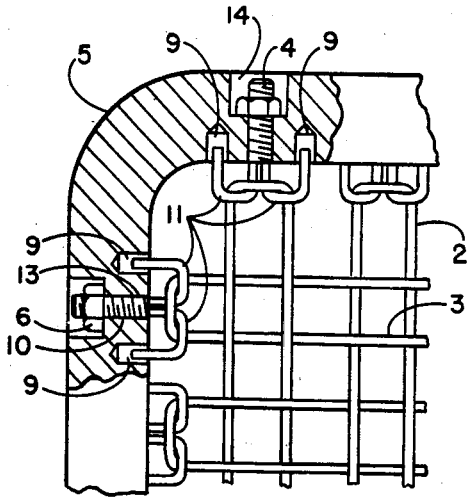
Figure 3:
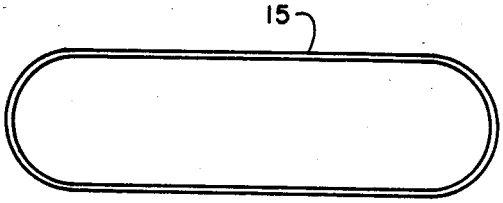

1. Racket handle
2. Vertical strings
3. Horizontal strings
4. Adjustable mounting stud threaded section
5. Outer racket frame surface
6. Threaded nut
7. Opposite mounting stud
8. Open throat section
9. Blind holes
10. Adjustable male threaded mounting stud section
11. Stud legs of mounting stud
12. Racket frame head
13. Frame hole
14. Recessed frame section FIG. 2—is an enlarged view of studs mounted in the racket frame and strings attached thereto wherein:

2. Vertical Strings
3. Horizontal strings
4. Adjustable mounting stud threaded section
5. Racket frame outer surface
6. Threaded nut
10. Male threaded mounting stud
11. Stud legs of mounting stud
13. Frame hole
14. Recessed frame section

FIG. 3

15. String loop

Figure 4:
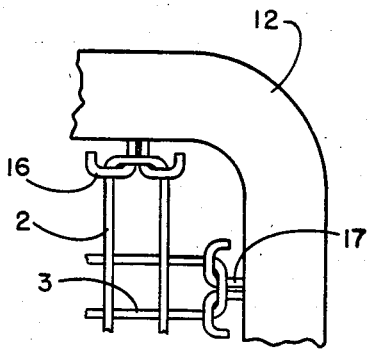
Figure 5:
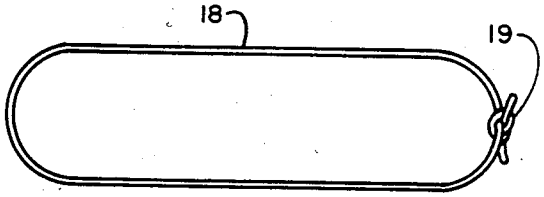

FIG. 4—Depicts non-adjustable stud legs wherein:

2. Vertical strings
3. Horizontal strings
12. Racket frame head
16. Loop string mount legs
17. Non-adjustable stud

FIG. 5

18. String loop
19. Knot joining ends of string loop

Figure 6:
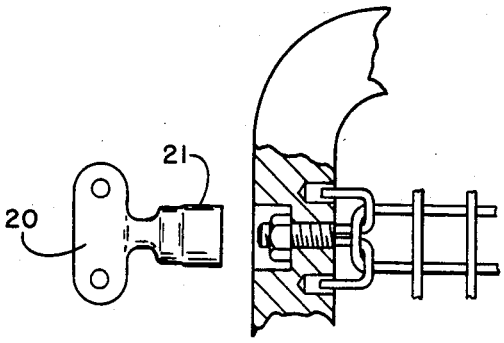

FIG. 6 is an enlarged view of wrench or key for tightening the string loop sections, where 20 is the key or wrench and 21 is the socket section to fit over the threaded nut 6.

DETAILED DESCRIPTION OF THE INVENTION

The racket frame 12, has vertical 2, and horizontal 3, strings. The strings 2, 3 are derived from string loops 15 or 18, which in essence are closed loops. The closed loop is best defined as an endless ring or loop which is fastened to adjustable mounting stud 4, to become the strings 2 or 3 in the racket 1.

To assemble and mount the strings in the racket frame head 12, a string loop section is mounted on stud legs of mounting stud 11, the male threaded mounting stud section 10 is then inserted in frame hole 13, and threaded nut 6 is then screwed onto said male threaded mounting stud 10. This same procedure is repeated for mounting the opposite end of the same loop on stud legs of mounting stud located on the opposite frame section shown as 7 in FIG. 1, or the opposite end of the string loop may be mounted on loop string mount legs 16 attached to non-adjustable stud 17 which stud 17 is rigidly mounted in racket frame 12. The adjustment of string tautness is then made by screwing nut 6 on male threaded stud section 4. The nut is screwed by use of key or wrench 20, of FIG. 6.

The racket strings can be mounted in the racket frame either by mounting one end of the string loop 15 or 18 on stud legs of mounting stud 11 on male threaded mounting stud 10 and held by threaded nut 6, on threaded stud section 4, and the opposite end of the string loop mounted on the stud legs of mounting stud 11 on the opposite side of the racket frame. This method of mounting then will allow for maximum movement outwardly of the stud legs to attain tautness of the strings.

As an alternate method of mounting racket strings in the racket frame, one end of the string loop 15 or 18 is mounted on stud legs of mounted stud 11 on male threaded mounting stud 10 and held by threaded nut 6, on threaded stud section 4 and the opposite end of the string loop is mounted on loop string mount legs 16, on non-adjustable stud 17.

The string loop as used in the above can be either an endless string loop 15 or a string made into a string loop 18 by means of a knot joining ends of string loop 19.

Blind holes 9 are so spaced to receive stud legs of mounting stud 11, when threaded nut 6 is tightened to make the string pair taut.

Figure 1:
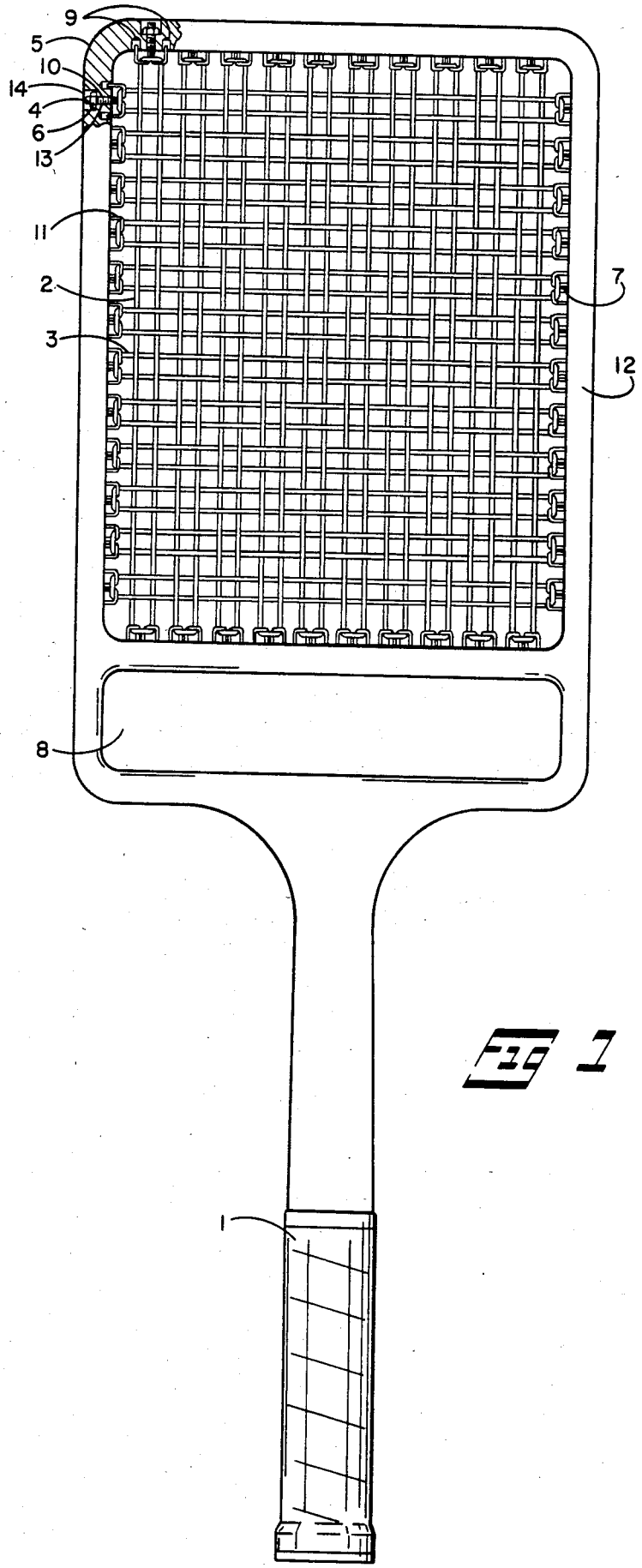

Open throat section 8 of FIG. 1 allows for tightening of loop strings by use of key or wrench 20 of FIG. 6.

Having described my invention, I claim:

1. A racket for tennis, wherein the improvement comprises a racket handle and rectangular racket frame head and means for adjusting string loop tautness, said means consisting of an adjustable mounting stud with a threaded section, mounted in said racket frame head, a threaded nut for engagement with said threaded stud section mounted in said racket frame head, and stud legs of said mounting stud fitting in blind holes in said racket frame head.

* * * * *